United States Patent [19]

Shinoda et al.

[11] Patent Number: 4,737,687

[45] Date of Patent: Apr. 12, 1988

[54] METHOD FOR DRIVING A GAS DISCHARGE PANEL

[75] Inventors: Tsutae Shinoda, Akashi; Atuo Niinuma, Suzaka, both of Japan

[73] Assignee: Fujitsu Limited, Kawasaki, Japan

[21] Appl. No.: 712,148

[22] Filed: Mar. 15, 1985

[30] Foreign Application Priority Data

Mar. 19, 1984 [JP] Japan ..... 59-053189
Apr. 16, 1984 [JP] Japan ..... 59-077421
Dec. 18, 1984 [JP] Japan ..... 59-267856

[51] Int. Cl.[4] ..... H05B 37/00; H05B 39/00; H05B 41/00

[52] U.S. Cl. ..... 315/169.4; 315/169.1; 340/713; 340/714; 340/805

[58] Field of Search ..... 315/169.4, 169.1; 340/776, 805, 713, 714, 775

[56] References Cited

U.S. PATENT DOCUMENTS 3,851,210 11/1974 Schermerhorn ..... 315/169.1
3,877,006 4/1975 Reboul et al. ..... 340/805
4,253,044 2/1981 Smith ..... 315/169.4
4,532,505 7/1985 Holz et al. ..... 340/775
4,591,847 5/1986 Criscimagna et al. ..... 340/776

*Primary Examiner*—David K. Moore
*Assistant Examiner*—Mark R. Powell
*Attorney, Agent, or Firm*—Staas & Halsey

[57] ABSTRACT

A method for driving a gas discharge panel having plural display electrode pairs and plural select electrodes arranged to intersect the display electrode pairs. The intersections of the select electrodes and one display electrode in each display electrode pair define a plurality of select cells and each display electrode pair defines plural display cells between the display electrodes at positions adjacent to respective ones of the select cells. The method includes the steps of applying a firing voltage across a display electrode pair to generate discharges in the display cells defined by the display electrode pair, generating a discharge in select cells corresponding to non-selected display cells, thereby eliminating the wall charge in and erasing the non-selected display cells, and applying a sustaining voltage across the display electrode pair to maintain discharges in the selected display cells.

14 Claims, 9 Drawing Sheets

(SUSTAIN) Y1
(ERASE ADDRESS) Y2
(SUSTAIN AFTER FIRED) Y3
(ONE LINE FIRE) Y4
Y5
Y6
Y7
Y8
(SUSTAIN)
X1
X2
X3
X4
X5
X6
X7
X8
W1 W2 W3 W4 W5 W6 W7 W8

X1 (SUSTAIN)
X2 (SUSTAIN)
X3 (ERASE ADDRESS)
X4 (SUSTAIN AFTER FIRED)
X5 (ONE LINE FIRE)
X6
X7
X8
(SUSTAIN)
Y1
Y2
Y3
Y4
Y5
Y6
Y7
Y8
W1 W2 W3 W4 W5 W6 W7 W8
ADDRESS SCANNING

METHOD FOR DRIVING A GAS DISCHARGE PANEL

BACKGROUND OF THE INVENTION

1. Field of the Invention

The present invention relates to an improved method for driving a gas discharge display panel, and more particularly, a method for stably driving a surface discharge or monolithic type gas discharge panel providing a wide operating margin.

2. Description of the Related Art

In gas discharge panels, known as plasma display panels, surface discharge or monolithic type display panels utilize lateral discharges between adjacent electrodes. Basically, as is disclosed in U.S. Pat. No. 3,646,384, issued to F. M. Lay, in a monolithic gas discharge panel of this type, the electrodes are disposed only on one substrate of a pair of substrates and are separated by a dielectric layer or layers. The electrodes on opposite sides of a dielectric layer are arranged to intersect and the intersections define discharge cells. The pair of substrates oppose each other and define a gap or space filled with a discharge gas. This structure provides the advantages of alleviating the requirement of an accurate gap spacing and the realization of multicolor displays which are created by coating the internal surface of the non-electrode bearing substrate with an ultraviolet ray excitation type phosphor. With the structure of the conventional panel, however, satisfactory panel life and operating margin could not be obtained beacuse the dielectric layer is damaged by a concentration of the discharge current at portions of the dielectric layer corresponding to the edges of the electrodes.

To prevent damage to the dielectric layer and to assure long panel life and stable operation, the inventors of the present invention have developed a three-electrode type AC surface discharge panel having separated select (or write) and display cells, as disclosed in copending U.S. patent application Ser. No. 640,579, filed Aug. 14, 1984, now U.S. Pat. No. 4,638,218 for GAS DISCHARGE PANEL AND METHOD FOR DRIVING SAME, which is assigned to the assignee of the present application. The panel structure disclosed in application Ser. No. 640,579 is called a three-electrode type AC surface discharge panel because each picture element, comprising a select cell and a display cell, is defined by the intersection of a select electrode with a pair of parallel display electrodes. The select cell is defined by the intersection of the select electrode and one of the display electrodes in the display electrode pair, and the display cell is defined by the space between the display electrodes adjacent to the select electrode. In addition to assuring long panel life and stable operation, a three-electrode type surface discharge panel provides an internal decoding function by employing multiple connections of the display electrode pairs, thereby simplifying the operation of driving the panel and the driving circuitry. However, the driving method disclosed in application Ser. No. 640,579 does not allow the panel to be addressed line-by-line if the display electrodes are multiply connected.

SUMMARY OF THE INVENTION

A primary object of the present invention is to provide an improved display addressing method for a three-electrode-type AC surface discharge panel which provides a large operating margin.

It is another object of the present invention to provide a driving method which stably addresses a three-electrode type monolithic display panel with a low driving voltage.

It is a further object of the present invention to provide a driving method for a three-electrode type monolithic panel having multiply connected display electrodes which provides for addressing with a line-by-line addressing sequence.

It is a still further object of the present invention to provide a method for driving a three-electrode type monolithic panel using a simplified and economical circuitry.

A method according to the present invention, for driving a monolithic gas discharge panel having plural picture elements, each picture element being formed of a display cell and a select cell, comprises the steps of firing the display cells defined by one pair of display electrodes, or line, by applying a firing voltage across the pair of parallel display electrodes forming the display cell line and erasing the discharges in non-selected display- cells, i.e., display cells which do not form a part of the intended display, by applying an erase voltage pulse to the select electrodes defining the select cells which form pairs with the non-selected display cells.

More particularly, the present invention relates to a method for driving a three-electrode type monolithic gas discharge panel. The display panel includes an electrode support substrate and a cover substrate. Display electrode pairs are arranged on the electrode support substrate and an electric or insulating layer is formed over the display electrodes. Plural select electrodes are arranged on the dielectric layer so that they cross the display electrode pairs, and an insulating layer is formed over the select electrodes and the dielectric layer; the cover substrate opposes the electrode support substrate to define a gas-filled discharge space or gap. Select cells are defined by the intersections of the select electrodes and one electrode of each pair of display electrodes, and display cells are defined at a plurality of points between each pair of display electrodes corresponding to the intersections of the select electrodes and the display electrodes. Each select cell and display cell pair form a picture element, the plural picture elements in a panel being arranged in a matrix. The method of the present invention comprises the steps of generating discharges, which are accompanied by the generation of wall charges, at all of the discharge cells defined between one pair of display electrodes by applying a firing voltage which exceeds a discharge start voltage across the pair of display electrodes, and selectively applying a voltage to the select electrodes which define the select cells of the non-selected picture elements to erase or remove the wall charge in the non-selected display cells. A discharge is maintained in the display cell of the selected picture elements by the application of an AC sustaining voltage across the display electrode pair.

Another feature of the present invention is the application of an asymmetrical composite sustaining voltage waveform. The asymmetrical composite sustaining voltage waveform supplies, to the display electrode in each display electrode pair which defines select cells at the intersection of the one display electrode and the select electrodes, a sustaining voltage having a larger amplitude than the sustaining voltage supplied to the other display electrode in a display electrode pair.

A further feature of the present invention is that the generation of discharges in all of the display cells defined by one pair of display electrodes is sequentially carried out for the plural pairs of display electrodes in a panel and that the erasing of the non-selected display cells of each line is carried out at a time which lags behind the generation of discharges by at least the amount of time between the generation of discharges in one line and the generation of discharges in a next line.

DESCRIPTION OF THE PREFERRED EMBODIMENTS

Figure 1:
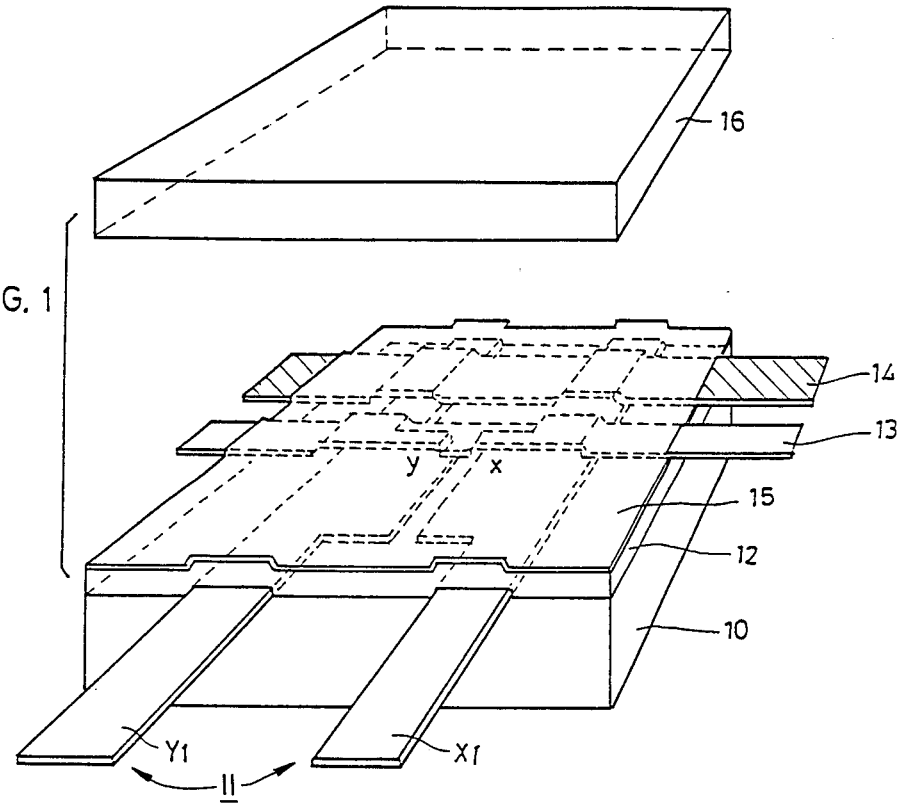
FIG. 1 is an isometric view showing the structure of a monolithic gas discharge panel to which a driving method of the present invention is applied.
Figure 2:
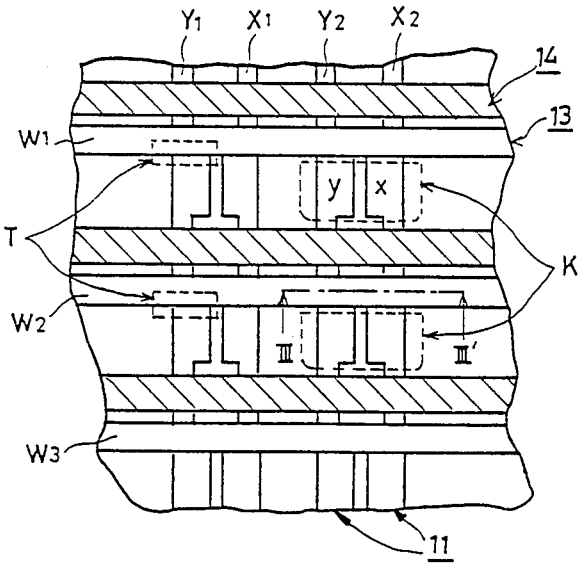
FIG. 2 is a plan view showing the electrode arrangement of the panel shown in FIG. 1.
Figure 3:
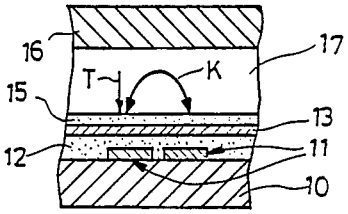
FIG. 3 is a cross-sectional view of a panel along the line III—III' in FIG. 2.

With reference to FIGS. 1, 2 and 3, a plurality of pairs of display electrodes 11 are arranged in a vertical direction on a lower glass substrate 10, the lower glass substrate 10 functioning as an electrode supporting substrate. Select electrodes 13, extending in a horizontal direction, and separator electrodes 14, also extending in a lateral direction, are separated from the display electrodes 11 by a dielectric layer 12 made of a low melting point glass. A surface layer 15 formed of for example, magnesium oxide (MgO) is formed on the select and separator electrodes and the dielectric layer 12 in a thickness of several thousand angstroms. A gas space 17, defined between the surface of the insulating layer 15 and an upper glass substrate 16, is evacuated and filled with a discharge gas, i.e., a gas capable of being ionized. A phosphor material which emits colored light when excited by ultraviolet rays may be provided on the internal surface of the upper glass substrate 16.

Each display electrode pair 11 comprises two adjacent display electrodes, e.g., X1, Y1 and X2, Y2, as is further apparent from FIG. 2, and each display electrode pair has discharge areas x and y which project from the adjacent sides of a pair of display electrodes 11. Select electrodes 13, e.g., W1, W2, are transverse to the display electrodes 11 and intersect the display electrodes 11 in the approximate area of the discharge areas x and y. Separator electrodes 14, for use in a floating condition, are parallel to the select electrodes 13 but do not intersect the discharge areas x and y; the separator electrodes 14 are provided on the opposite side of the select electrodes 13 from the discharge areas x and y. Thus, select cells T are defined by, for example, the intersecting point of the select electrodes W1, W2 and the display electrodes Y1, Y2, and display cells K are defined by the area between the discharge areas x, Y. A picture element (PIXEL) corresponding to one dot is formed by a select cell T in a corresponding display cell K and is defined by the three types of electrodes X, Y and W.

In a three-electrode type discharge panel, the creation of a discharge in a selection cell T affects the adjacent display cell due to the coupling of space charges or the spread of wall charges. In particular, a discharge in a select cell T is accompanied by the generation of wall charges on the surface of the insulating layer 15 at a position corresponding to the select cell T. The wall charges accumulate and extend over the surface of the insulating layer 15 to the approximate position of a corresponding display cell K. Therefore, when a sustaining voltage is applied to the display electrode pair, a discharge is generated at the display cell, as described in application Ser. No. 640,579. However, the discharge in the display cell K can be erased by generating a discharge in the corresponding select cell T; the discharge in the select cell T causes the space charges, and wall charges in the display cell K to generate a self-discharge which consumes the wall charges, and thus erases the display cell K.

The driving method of the present invention relates to an erasing address sequence for erasing discharges in non-selected display cells. In the method of the present invention all of the display cells defined by a pair of display electrodes 11 are fired by applying a firing voltage across the display electrode pair 11. The non-selected display cells are erased by creating discharges in the select cells corresponding to the non-selected display cells to perform a vicinity erasing function. The method of the present invention will be explained in detail with reference to FIGS. 4 and 5.

Figure 4:
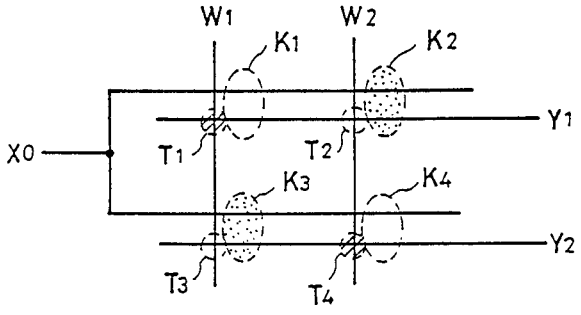
FIG. 4 is a schematic diagram showing an electrode configuration and the discharge cell arrangement for describing the driving method of the present invention.

FIG. 4 is a schematic diagram of an example of the electrode configuration in a three-electrode type monolithic display panel having four (2×2) display cells (PIXELS). Two X display electrodes, connected in common and designated $X_0$, and the two Y display electrodes, designated $Y_1$ and $Y_2$, form display electrode pairs with respective ones of the electrodes in the display electrode group $X_0$. Two select electrodes $W_1$ and $W_2$ are separated from the display electrodes by dielectric layer and arranged so that they intersect the display electrodes. Select cells $T_1$–$T_4$, for generating discharges, are formed at the intersections of the display electrodes $Y_1$, $Y_2$ and the select electrodes $W_1$, $W_2$, and display cells $K_1$–$K_4$, for displaying information, are defined between the display electrode pairs in the vicinity of the select cells $T_1$–$T_4$, respectively.

Figure 5:
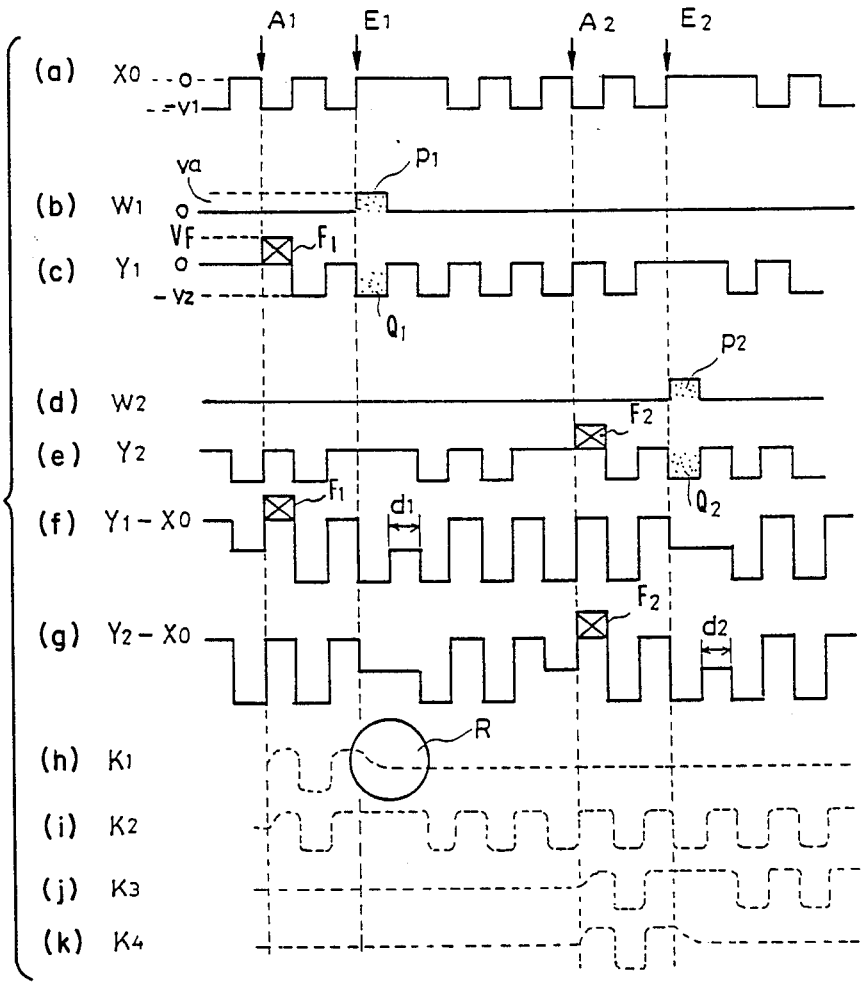
FIGS. 5(*a*)–(*k*) are examples of driving voltage waveforms used in the method of driving a gas discharge panel according to the present invention.

FIGS. 5(*a*)–(*e*) illustrate voltage waveforms which are applied to the electrodes $X_0$, $W_1$, $Y_1$, $W_2$, and $Y_2$ respectively. FIGS. 5(*f*) and (*g*) illustrate composite voltage waveforms applied across the pairs of display electrodes, $Y_1$ and $X_0$, and $Y_2$ and $X_0$, and FIGS. 5(*h*)–(*k*) illustrate equivalent voltage waveforms for display cells $K_1$–$K_4$, i.e., the voltage which is accumulated on the wall surface of the dielectric material during the discharges of the display cells $K_1$–$K_4$. Time increases from left to right in FIGS. 5(*a*)–(*k*).

The method of the present invention for applying the voltage waveforms shown in FIGS. 5(*a*)–(*e*) is as follows: At time $A_1$, a firing pulse $F_1$, having a voltage $V_F$ is applied to display electrode $Y_1$ and a voltage pulse, having a voltage $(-V_1)$ is applied to display electrode $X_o$. Thus, a composite voltage value of $|V_1|+|V_F|$, which exceeds the firing voltage of the display cells defined by the pair of electrodes $X_0$, $Y_1$, is applied across these electrodes. As a result, discharges are initiated in display cells $K_1$ and $K_2$ (i.e., a first line of display cells). The discharges in display cells $K_1$ and $K_2$ generate wall charges which are accumulated on the surface of the insualting layer 15. The voltages of the wall charges are illustrated in FIGS. 5(*h*) and (*i*).

At time $E_1$, a selection pulse $P_1$ is applied to select electrode $W_1$. The selection pulse $P_1$ has a voltage amplitude $V_a$ and a pulse width which is equal to the pulse width of a sustaining voltage pulse defined by the composite voltage waveform $Y_1$–$X_0$ shown in FIG. 5(*f*). The amplitude $V_a$ of the select pulse $P_1$ is set so that the value of a composite voltage, defined by the absolute value of $V_a$, plus the absolute value of the voltage $(-V_2)$ of a sustaining pulse $Q_1$ which is applied to the display electrode $Y_1$, is large enough to generate a discharge in select cell $T_1$. At time $E_1$, a wall charge generated by the discharge in discharge cell $K_1$ spreads over the surface of the insulating layer 15 in the region of the select cell $T_1$, and the wall charge aids in the generation of a discharge in select cell $T_1$. Therefore, when display cell $K_1$ is firing or discharging, a discharge can be generated in select cell $T_1$ by a lower voltage than in the situation where display cell $K_1$ is not firing.

When the pulses $P_1$ and $Q_1$ are applied to select electrode $W_1$ and display electrode $Y_1$, respectively, a discharge occurs in select cell $T_1$ at the rising edge of the pulses $P_1$ and $Q_1$, i.e., at the time $E_1$. The discharge in select cell $T_1$ neutralizes some of the wall charge accumulated on the surface of the dielectric layer 15 in the adjacent display cell $K_1$. Further, the wall charge generated in the select cell $T_1$ creates a self-discharge in the select cell $T_1$, due to the avalanche phenomenon of the wall charge, when the composite voltatge of pulses $P_1$ and $Q_1$ falls. The self-discharge further reduces the wall charge in the adjacent display cell $K_1$, and eliminates the wall charge in the select cell $T_1$. The attenuation profile of the voltage of the wall charge in the display cell $K_1$ is indicated in the circle R in FIG. 5(*h*). Further, immediately after the application of the select pulse $P_1$, no voltages are applied to the display cell $K_1$, and the self-discharge generated at the falling edge of the pulses applied to the select cell $T_1$ brings the wall charge in the display cell $K_1$ to zero as shown in FIG. 5(*h*). To assure the attenuation of the wall charge, the sustaining voltage for the display electrode $X_0$ is held at zero volts during the period $d_1$ shown in FIG. 5(*f*). Thus, a discharge in the display cell $K_1$ can be accurately erased.

Meanwhile, the wall charge accumulated on the surface of the dielectric layer 15 in display cell $K_2$ by the discharge occurring therein at time $A_1$ is maintained on the dielectric layer 15 since a selection pulse is not applied to select electrode $W_2$ defining select cell $T_2$. Accordingly, when a sustaining voltage is applied across electrodes $X_0$ and $Y_1$, after the application of the select pulses $P_1$ and $Q_1$, a discharge is generated and maintained in display cell $K_2$. This completes the addressing of the first line so that display $K_2$ is firing or selected, and so that display $K_1$ is not firing or nonselecting.

To address the second line, a firing pulse $F_2$ is applied across the display electrode pair $X_0$ and $Y_2$ and the time $A_2$, thereby generating discharges in display cells $K_3$ and $K_4$. In the case of the second line, where it is desired to select display cell $K_3$, a selection pulse $P_2$ is applied to the select electrode $W_2$ at time $E_2$ so that a pulse having a composite voltage $|V_a|+V_2|$ is applied to select cell $T_4$. This generates a discharge in select cell $T_4$ thereby eliminating the wall charge in display cell $K_4$ and erasing display cell $K_4$ during the period $d_2$ when the sustaining voltage applied to display cell $K_4$ is zero. As a result, the discharge is maintained only in display cell $K_3$.

Figure 6:
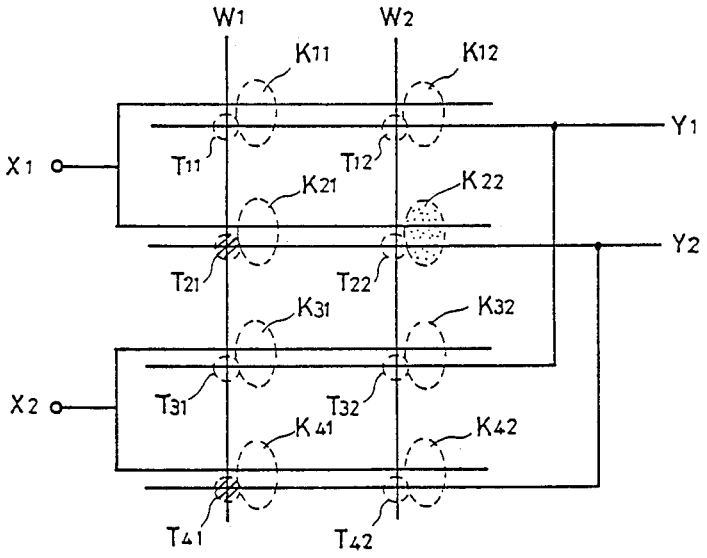
FIG. 6 is a schematic diagram showing multiply connected electrodes.
Figure 7:
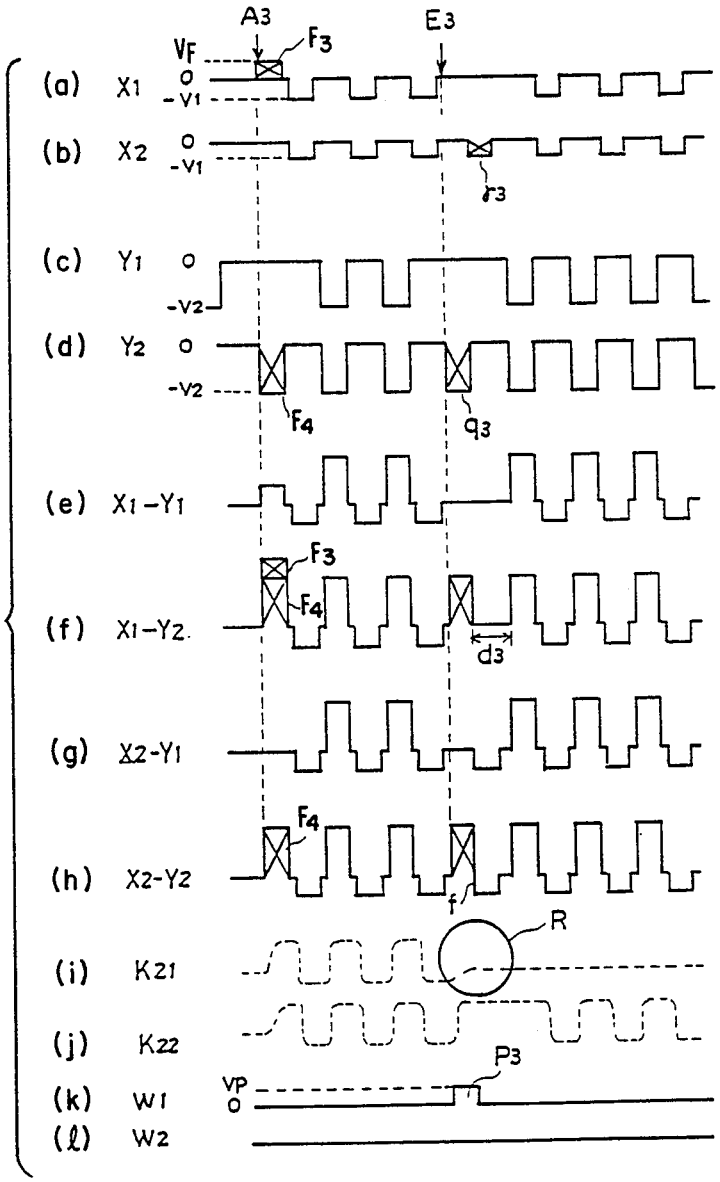
FIGS. 7(*a*)–(*l*) are voltage waveforms for driving a panel having the multiple electrode connections shown in FIG. 6.

A second embodiment of the present invention is a method for driving a surface display panel having multiply connected display electrode pairs, which provide an internal decoding function, with reference to FIGS. 6 and 7. FIG. 6 is a schematic diagram of a panel having eight PIXELS (2×4), wherein the display electrode pairs are divided into plural groups, i.e., two groups. In particular, electrodes $X_1$ and $X_2$ are formed by connecting two adjacent X display electrodes in common, and electrodes $Y_1$ and $Y_2$ are formed by connecting corresponding Y display electrodes from each group formed by electrodes $X_1$ and $X_2$ in common. Thus, display cells $K_{11}$ and $K_{12}$ are defined along the electrode pair ($X_1$, $Y_1$), display electrodes $K_{21}$ and $K_{22}$ are formed along the electrode pair ($X_1$, $Y_2$), display cells $K_{31}$ and $K_{32}$ are formed along the electrode pair ($X_2$, $Y_1$), and display cells $K_{41}$ and $K_{42}$ are formed along the electrode pair ($X_2$, $Y_2$) Further, select cells $T_{11}$, $T_{12}$, . . . , $T_{42}$ are formed at the respective intersecting points of the display electrodes $Y_1$ and $Y_2$ and the select electrodes $W_1$ and $W_2$, the select cells being adjacent to a corresponding display cell so that discharges in the select cells affect the wall charges and space charges in the corresponding display cells.

FIGS. 7(*a*)–(*l*) are examples of voltage waveforms utilized to drive a panel having the multiple electrode connections shown in FIG. 6. In particular, the waveform shown in FIG. 7 are an example of waveforms used to create a discharge in display cell $K_{22}$ when a panel having the multiple electrode connections showin in FIG. 6 is in operation, including the presence of fired cells and nonfired cells. The waveforms $X_1$, $X_2$, $Y_1$ and $Y_2$, shown in FIGS. 7(*a*)–(*d*), are applied to the display electrodes $X_1$, $X_2$, $Y_1$ and $Y_2$. The waveforms $X_1$–$Y_1$, $X_1$–$Y_2$, $X_2$–$Y_1$ and $X_2$–$Y_2$, shown in FIGS. 7(*e*)–(*h*), are composite voltage waveforms applied across the respective electrode pairs, and the waveforms $K_{21}$ and $K_{22}$, shown in FIGS. 7(*i*) and (*j*) illustrate the voltage of the wall charge accumulated on the surface of the dielectric layer 15 in display cells $K_{21}$ and $K_{22}$. Further, the waveforms $W_1$ and $W_2$, shown in FIGS. 7(*k*) and (*l*), illustrate select pulses applied to the select electrodes $W_1$ and $W_2$.

To generate discharges in the display cells formed along the electrode pair ($X_1$, $Y_2$), i.e., display cells $K_{21}$ and $K_{22}$, firing pulses $F_3$ and $F_4$ are simultaneously applied to the display electrodes $X_1$ and $Y_2$, respectively, at time $A_3$. The composite voltage pulse having an amplitude of $|V_1|+|V_w|$, which exceeds the discharge voltage, creates these discharges. After allowing two cycles for the discharges to stabilize, selection pulses $P_3$ and $Q_3$ are applied to electrodes $W_1$ and $Y_2$, respectively, to generate a discharge in select cell $T_{21}$, at time $E_3$. As described above, the wall charge is eliminated in display cell $K_{21}$ the cell is removed. The elimination or removal of the wall charge is shown in the circle R in the voltage diagram $K_{21}$ of FIG. 7(*i*). However, the wall charge is maintained in display cell $K_{22}$ and a discharge is generated when a sustaining voltage is applied. The sustaining voltage must be reapplied to display cell $K_{22}$ because the voltage applied to the cell is zero during the period $d_3$, which occurs at the falling edge of the composite voltage pulse $P_3+Q_3$, to assure elimination of the wall charge in display cell $K_{21}$.

The effect of the application of the asymmetrical selection pulses $W_4$ and $Q_3$ on cells other than those described above are as follows. Select cell $T_{41}$ receives the select pulses $P_3$ and $Q_3$ and a select discharge is generated in select cell $T_{41}$. Thus, display cell $K_{41}$ would be erased. However, a supplemental selection pulse $r_3$ is applied to the sustaining electrode $X_2$ immediately after the selection pulses $P_3$ and $Q_3$. This supplemental selection pulse $r_3$ has a voltage $(-V_1)$ which is large enough to generate a redischarge in the display cell $K_{41}$, thereby continuing the discharge in display cell $K_{41}$ and generating a new wall charge. Display cells $K_{12}$, $K_{32}$ and $K_{42}$, corresponding to select electrode $W_2$, are not disturbed because the select pulse $P_3$ is not applied to the select cells corresponding to these discharge cells. Further, the discharge condition of display cells $K_{11}$ and $K_{31}$, corresponding to select electrode $W_1$, to which the select pulse $P_3$ is applied, is not changed because the asymmetrical selection pulse $Q_3$ is not applied to display electrode $Y_1$.

One purpose of the second embodiment is to enable the select electrodes, e.g., $W_1$ and $W_2$, to be driven by a low voltage integrated circuit (IC) driving element. The asymmetrical select pulses $P_3$ and $Q_3$ utilized in the method of the present invention allow a reduction of voltage level $V_p$ of the select pulse $P_3$. In particular, since the voltage applied to select cell $T_{21}$ has a voltage of $|V_2|+|V_p|$, the value of the voltage value $(-V_2)$ of the select pulse $Q_3$ may have a large peak value in order to allow a reduction in the voltage $V_P$ of the select pulse $P_3$. For example, the voltages may be as follows: $V_2=-160$; $V_1=-100$, and $V_F=80$. With these voltages, normal addressing operation has been attained when $V_P=20\sim50$. Accordingly, the select electrodes can be driven with a voltage of approximately 30 volts by a low voltage IC.

Figure 8:
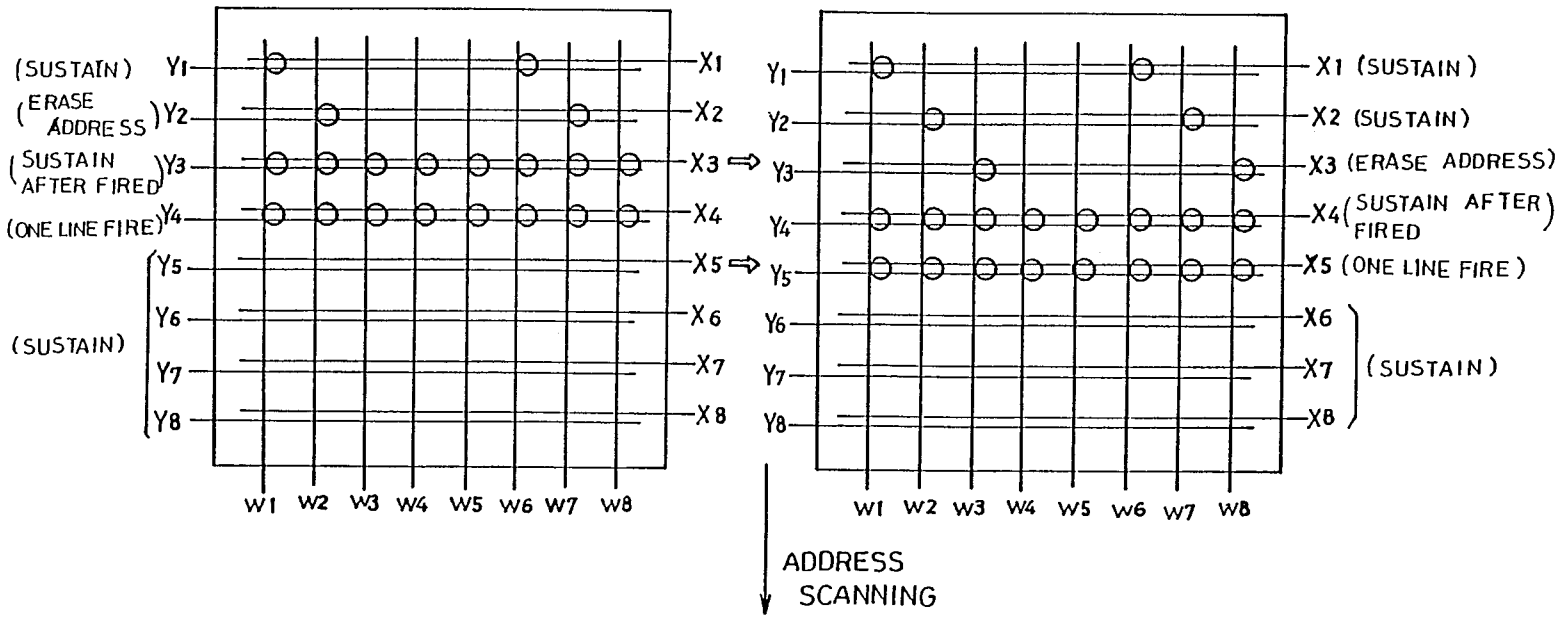
FIGS. 8(*a*) and (*b*) are schematic diagrams of panels in which the sustaining electrodes are multiply connected for describing an addressing sequence for such panel.

A third embodiment of an improved method for driving a gas discharge display panel in accordance with the present invention will be explained with reference to FIGS. 8–10. One feature of the third embodiment is that each line, or electrode pair, in a panel is sequentially fired, or caused to discharge, and then subject to an erase/address sequence. FIGS. 8(*a*) and (*b*) are schematic diagrams showing the states of 64 PIXELS (8×8) in a panel subject to the line address sequence of the third embodiment of the present invention. In particular, FIGS. 8(*a*) and (*b*) sequentially illustrate the line addressing sequence advancing by one line. In FIGS. 8(*a*) and (*b*) display cells which are discharging are illustrated by a circle. The display electrodes i (i=1, 2, 3, . . . , 8) are connected in common, with each electrode forming a pair ($X_i$, $Y_i$) with a corresponding Y display electrode $Y_i$ (i=1, 2, 3, . . . , 8), and the line address sequence procedes in ascending order of the electrode number i.

Figure 9:
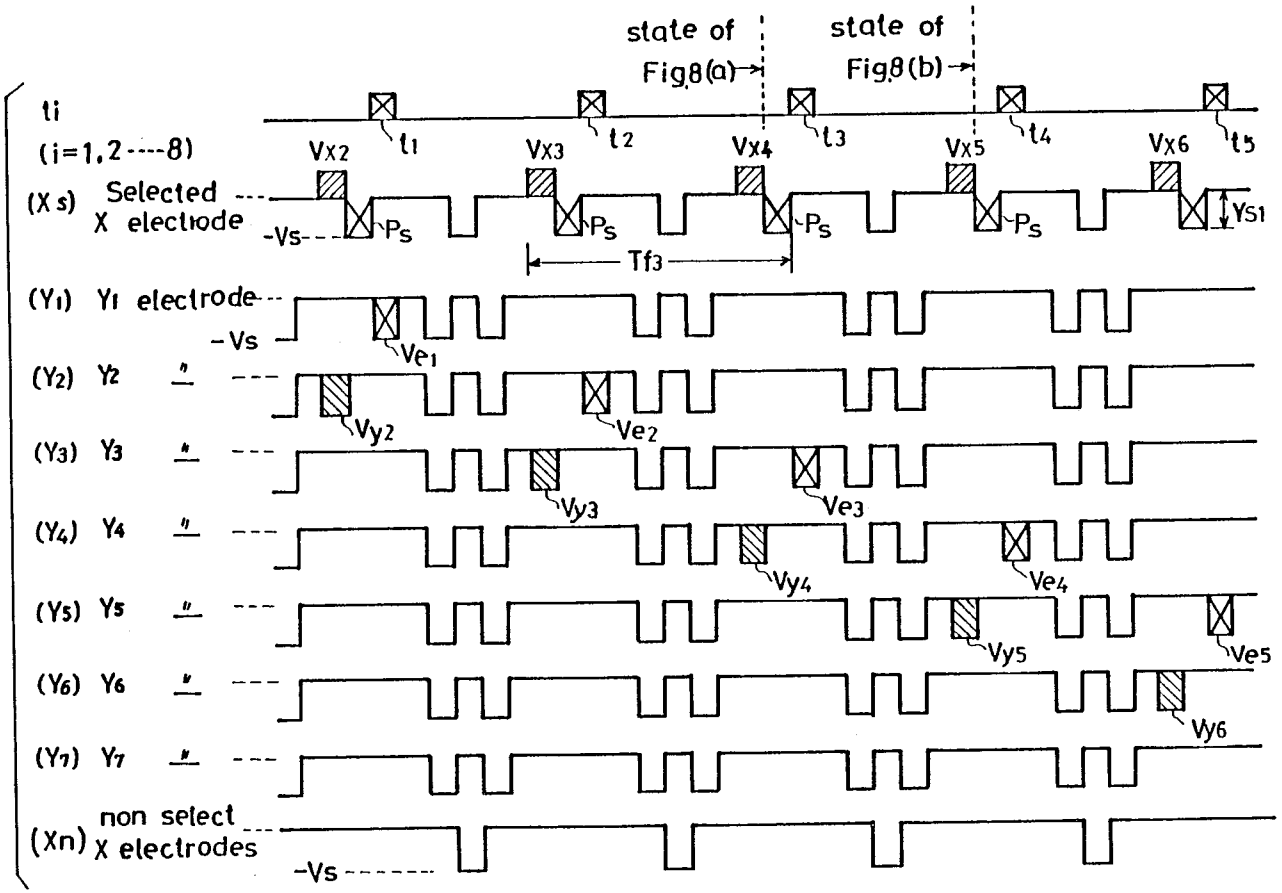
FIG. 9 shows examples of driving voltage waveforms corresponding to the addressing sequence shown in FIGS. 8(*a*) and (*b*)

FIG. 9 illustrates the waveforms utilized in the third embodiment of the driving method of the present invention, particularly, the line addressing sequence shown in FIGS. 8(*a*) and (*b*). The waveforms $T_i$ shows erasing half-select pulses applied to select electrodes $W_j$ (j=1, 2, 3 . . . 8), a half-select pulse being the pulse applied to one of a pair of matrix electrodes when a composite voltage is achieved by applying pulses to two electrodes. The erasing half-select pulses are applied to the select electrodes forming select cells adjacent to non-selected display cells to eliminate the wall charge in the non-select display cells, thereby performing an erasing/address operation. The waveform $X_s$ is applied to a selected group of X display electrodes, e.g., $X_1$–$X_8$, and the waveforms $Y_1$, $Y_7$ are applied to the respective Y electrodes. The waveform $X_n$ is applied to non-selected X display electrodes (not shown). The difference between the waveforms $X_s$ and $X_n$ is that the waveform $X_s$ includes selective sustaining pulses $P_s$ for reversing the polarity of the voltage of the wall charge in the display cells along the selected X electrodes at a time prior to the application of the erase half-select pulses to the select electrodes $W_i$. The voltage pulses $V_{xi}$ and $V_{yi}$ apply a composite voltage which is greater than the firing voltage across the i-th electrode pair to generate discharges in all of the display cells on the i-th electrode pair. For example, the pulses $V_{x3}$ and $V_{y3}$ generate discharges in all of the cells on the third line, i.e., the display electrode pair ($X_3$, $Y_3$).

With reference to the third line, electrode pair ($X_3$, $Y_3$), by way of example, erasing half-select pulse $V_{e3}$ is applied to display electrode $Y_3$ at a time corresponding to the application of the erasing half-select pulse $t_3$. The timing of the pulses $T_3$ and $V_{e3}$ is delayed by period $T_{f3}$ from the pulses $V_{x3}$ and $V_{y3}$ in order to allow the wall charge in the selected cells to stabilize. Further, the erase half-selection pulse $T_3$ is applied to all of the select electrodes $W_j$ defining select cells are corresponding to non-selected display cells to be erased.

The timing of the sequential addressing of the electrode pairs is such that the firing pulses $V_{x4}$ and $V_{y4}$ for the fourth line are applied to the display electrode pair ($X_4$, $Y_4$)prior to the erase addressing of the third electrode pair.

Figure 10:
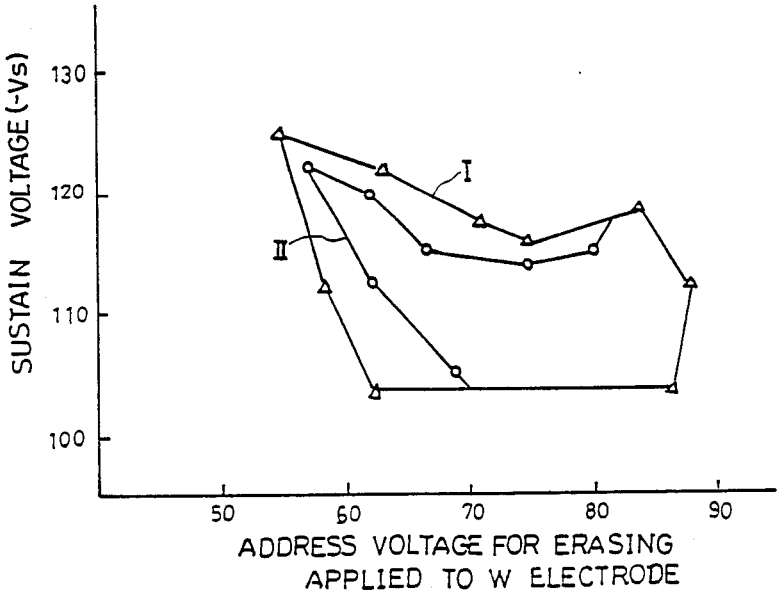
FIG. 10 is a graph of experimental data showing the operating margin of a panel operated with the driving method of the present invention.

FIG. 10 is a graph of experimental data illustrating the operating margins for the first and third embodiments of the present invention. The horizontal axis represents the voltage of the half-selection pulse applied to the select electrodes and the vertical axis represents the voltage of the sustaining pulses applied to the display electrodes. In particular, the region enclosed by curve I illustrates the operating range for the line addressing sequence of the third embodiment of the present invention, and the region enclosed by curve II illustrates the operating range in the erasing address system of the first embodiment of the present invention. The data for curves I and II was obtained with a panel having 19,200 PIXELS, i.e., 240 lines (or display electrode pairs) and 80 select electrodes, with a 0.6 mm dot pitch. The X display electrodes were connected in 15 groups and the Y display electrodes were connected in 16 groups. In the experimental panel the dielectric layer 12 separating the display electrodes in the select electrodes had a thickness of 12 μm and the surface dielectric layer 15 was formed of magnesium oxide (MgO) in a thickness of 0.4 μm. The gas was a mixture of Ne and 0.2 percent Xe at a pressure of 500 Torr. As shown in FIG. 10, a wider operating margin is obtained with the line addressing sequence of the third emhodiment than with the addressing method of the first embodiment.

Figure 11:
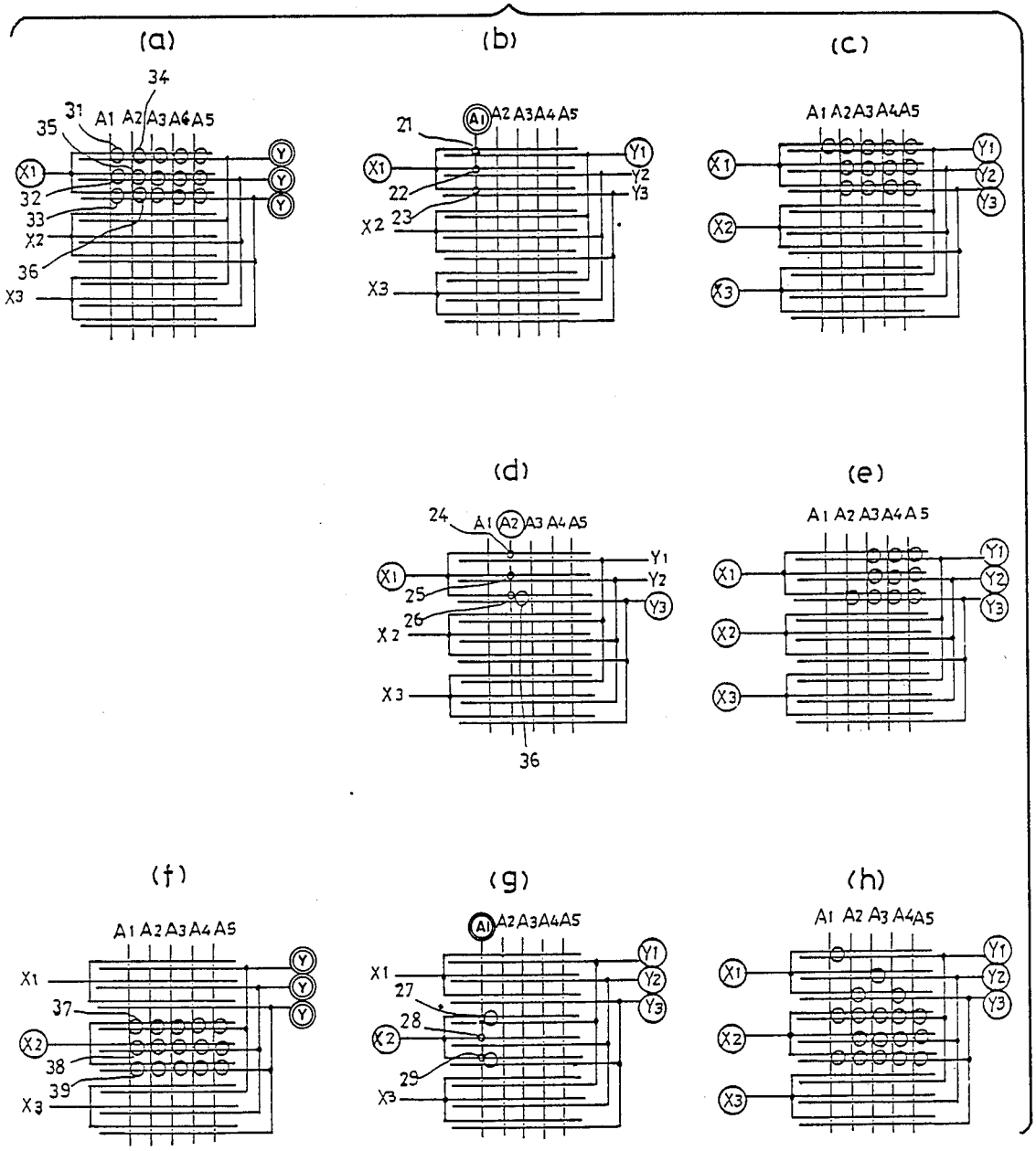
FIGS. 11(*a*)–(*h*) are schematic diagrams of panels in which the sustaining electrodes are multiply connected for describing an addressing sequence for such panels in accordance with a modified embodiment of the method of the present invention.

A further example of the addressing method of the present invention will be explained with reference to FIGS. 11 and 12. FIGS. 11(*a*)–(*h*) illustrate various steps in the addressing of a display panel having 9 display pairs $X_i$ and $Y_i$ (i=1,2,3, . . . ,9) divided into 3 groups of X and Y electrodes, and 5 select electrodes $A_{1-A5}$. In FIGS. 11(*a*)–(*h*) the various electrodes $A_i$, $X_i$ and $Y_i$ enclosed by a double circle (◎) are undergoing an erasing operation, the electrodes enclosed by a single circle () are receiving the sustaining voltage pulses for a selected electrode, and the electrodes which are not circled are receiving the sustaining voltage pulse for non-selected electrodes.

Figure 12:
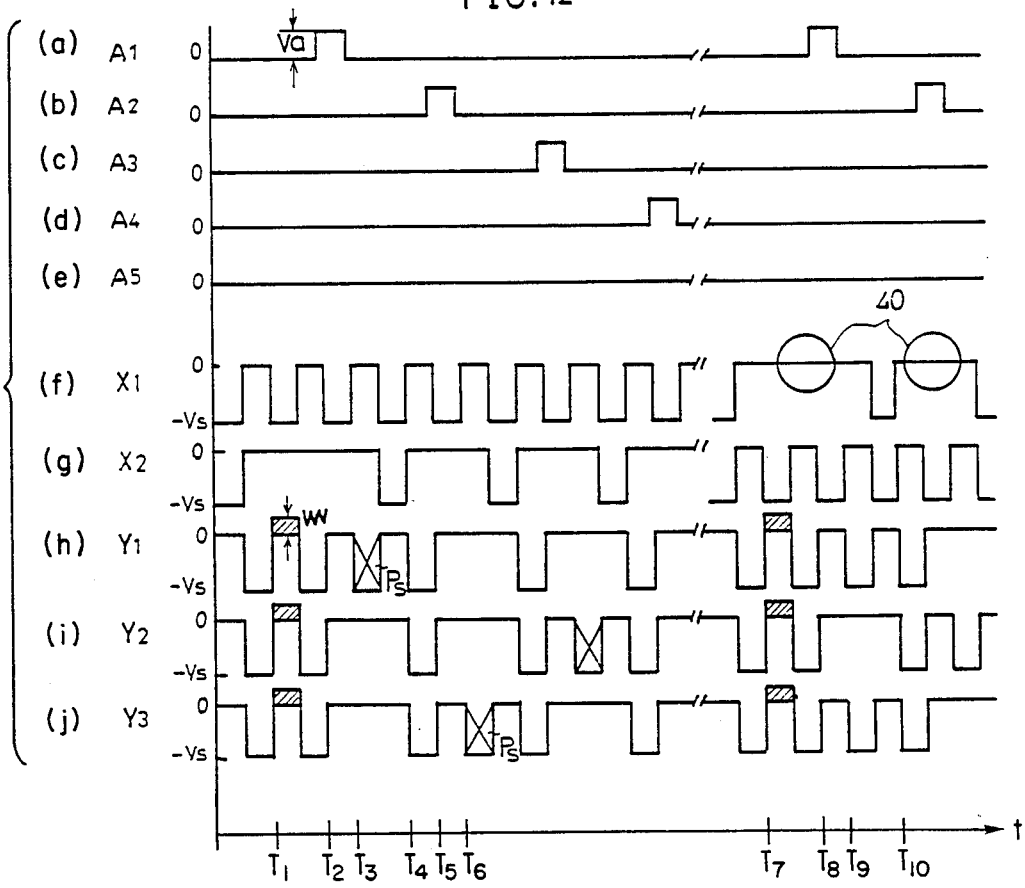
FIGS. 12(*a*)–(*j*) are examples of driving voltage waveforms used in the addressing sequences shown in FIG. 11.

FIGS. 12(*a*)–(*j*) show waveforms corresponding to the states of the display cells and select cells of the panel shown in FIG. 11. In particular, waveforms $A_1$–$A_5$ in (FIGS. 12(*a*)–(*e*)) apply selection pulses having a positive voltage $V_a$ to respective ones of the select electrodes $A_{1-A5}$. Waveforms $X_1$ and $X_2$, and $Y_1$–$Y_3$ (FIGS. 12(*f*)–(*j*)) are applied to respective ones of the display electrodes $X_i$ and $Y_i$. Further, an ordinary sustaining voltage waveform is applied to the selected display electrodes and a sustaining voltage waveform having certain pulses extracted therefrom is applied to the non-selected display electrodes.

With reference to FIG. 11(*a*), and FIGS. 12(*f*) and (*h*)–(*j*), a write pulse $V_w$ is applied across the display electrode $X_1$, and all of the Y electrodes forming pairs with the X display electrode $Y_1$, from the Y display electrode side at a time $T_1$. The composite voltage $|V_s|+|V_w|$ generates discharges in all of the display cells along the electrode pairs formed by display electrode $X_1$. Then, at time $T_2$ an erase select pulse, having a positive voltage $V_a$, is applied to select electrode $A_1$ to generate discharges in select cells 21, 22, and 23 formed at the intersections of the display electrode $X_1$ and select electrode $A_1$. If a discharge is to be maintained at display cell 31, located between the electrode pair ($X_1$, $Y_1$) in the vicinity of the select electrode $A_1$, a sustained pulse $P_s$ is applied to the display electrode $Y_1$ at time $T_3$. However, at time $T_3$ the sustaining pulses are extracted from the sustaining voltage waveforms supplied to the non-selected electrodes $Y_2$ and $Y_3$. Therefore, the wall charges and space charges in display cells 32 and 33 are eliminated by the self-discharge which is generated in the select cells 22 and 23 at the falling edge of the select pulse applied to the select electrode $A_1$. As a result, the discharges in display cells 32 and 33 are erased. At time $T_4$ sustaining voltage pulses are applied between all of the X and Y display electrodes to maintain the discharges generated in the display cells formed between the display electrode pairs ($X_1$, $Y_2$), and ($X_l$, $Y_3$) which were not erased.

Thereafter, a select pulse $V_a$ is applied to select electrode $A_2$ at time $T_5$ in order to generate discharges in select cells 24, 25 and 26; however, a sustaining voltage pulse $P_s$ is applied to display electrode $Y_3$ to maintain the discharge in display cell 36 at time $T_6$. Thus, the discharges in the display cells associated with select cells 24 and 25 are erased and the display which appears when the next sustaining voltage pulses applied is shown FIG. 11(*e*). An explanation of the addressing operation for select electrodes $A_3$, $A_4$, and $A_5$ in conjunction with the display electrode pairs formed by display electrode $X_1$ will be ommitted to avoid repetition.

The operation of the display cells formed by the display electrode $X_2$ will be described with reference to FIGS. 11(*f*)–(*h*). First, all of the display cells along the electrode pairs ($X_2$, $Y_1$), ($X_2$, $Y_2$) and ($X_2$, $Y_3$) are caused to discharge by applying a write pulse across all of these electrode pairs from the Y electrode side at time $T_7$. At this time, the display cells formed by the display electrodes $X_1$ and $X_3$ are storing the wall charges formed therein since the sustaining voltage pulses are extracted from the sustaining voltage waveform during the selecting/addressing operation for display electrode $X_2$, as shown by the circles 40 in FIG. 12(*f*). At time $T_8$, a selection pulse is again applied to the select electrode $A_1$ to fire the select cells 27, 28, and 29 located at the intersection of select electrodes $A_1$ and display electrode $X_2$. In order to erase the discharge in the display cell 38 associated with select cell 28, a sustaining voltage pulse is not applied to display electrode $Y_2$ at time $T_9$. Thus, the wall charges and space charges in display cell 38 are eliminated, as shown in FIG. 11(*g*). Also at time $T_9$, sustaining voltage pulses are applied to the display cells located at the intersection of display electrode $X_2$ and display electrodes $Y_1$ and $Y_3$, i.e., display cells 37 and 39, in order to maintain a discharge in these display cells. At time $T_{10}$, when sustaining voltage pulses are applied to all of the display cells in the panel, display cell 38 does not discharge, whereas display cells 37 and 39 do discharge, as shown in FIG. 11(*h*).

Figure 13:
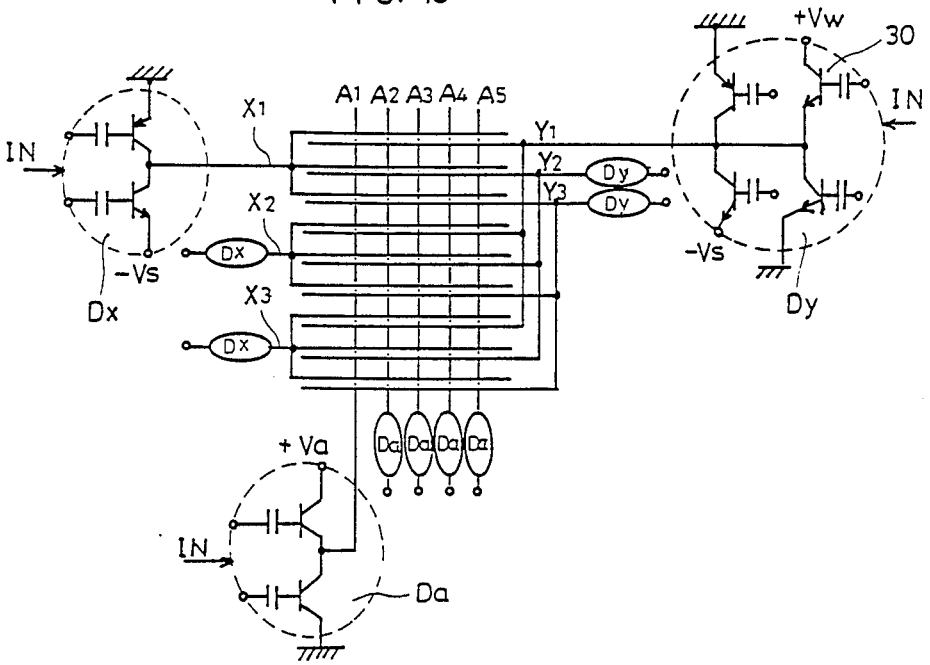
FIG. 13 is a schematic diagram of a panel in which the sustaining electrodes are multiply connected and typical driving circuitry for performing the driving method of the present invention.

FIG. 13 illustrates typical high voltage drivers which are provided at the periphery of a display panel for operation in accordance with the addressing method of the present invention. In particular, $D_x$ and $D_y$ are the drivers for driving display electrodes $X_i$ and $Y_i$, respectively, which output the sustaining voltage pulses having a voltage ($-V_s$) shown in FIG. 12. $D_a$ is a driver for driving the select electrodes $A_i$ which outputs the select pulses having a voltage $V_a$, as shown in FIG. 12. The Y electrode drivers $D_y$ include a switching element 30 for supplying the write voltage pulse having a voltage $V_W$. The circuit configuration of the drivers $D_x$, $D_y$ and $D_a$ is well suited for providing the voltage waveforms shown in FIGS. 5, 9 and 12.

Figure 14:
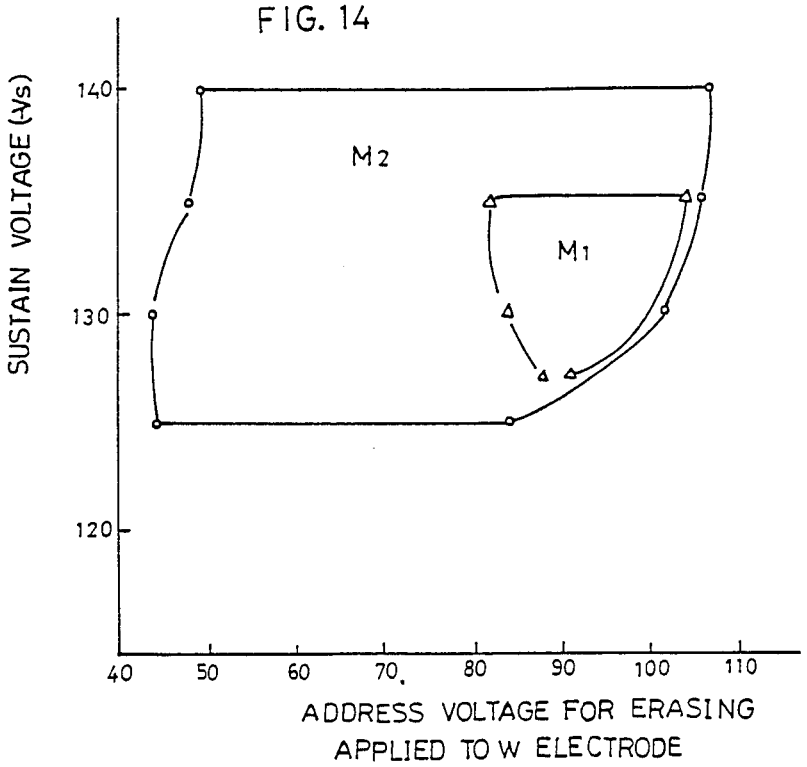
FIG. 14 is a graph of the operating margin achieved with the addressing sequences shown in FIG. 11.

FIG. 14 is a graph illustrating the operating margin obtained with the addressing method discussed with respect to FIGS. 11 and 12. In FIG. 14 the horizontal axis represents the amplitude of the select pulse applied to the select electrodes $A_i$ and the vertical axis represents the peak value of the sustaining voltage pulses applied to the sustaining electrodes $X_i$ and $Y_i$. The area $M_1$ is an example of the operating margin of a prior art addressing method. The area $M_2$ is the operating margin obtained with the method of the present invention as described with respect to FIGS. 11 and 12, which is remarkable in that it is greatly enlarged in the low voltage range of the selection pulse.

It will be understood from the above description of the addressing method of the present invention that the wall charge in a display cell is eliminated by generating a discharge in the select cell corresponding to the display cell after the display cell has been fired. The select cell is fired by applying an erase pulse, and a self-discharge occurs in the display cell, due to the presence of wall charges, at the falling edge of the pulse applied to the select cells, thereby consuming the wall charge in the display cell. Accordingly, the wall charges can be eliminated and a discharge in the display cell erased over a wide range of sustaining pulse voltages. Moreover, in accordance with the method of the present invention, difficulties in firing only selected discharge cells are eliminated since display cells are all discharged and then selected discharge cells are erased.

In addition, the voltage of the selection pulse for generating a discharge in the select cells can be a relatively low voltage because the wall charges generated in the display cells when the display cells are fired, prior to the erasing operation, aid in generating a discharge in the select cells. Furthermore, a low voltage IC driving element can be used to generate the select pulses since the firing voltage for the select cells is generated by asymmetrical voltage pulses. Moreover, the electrode arrangement described for use with the addressing method of the present invention allows sequential addressing of each line and a simplification of the driving circuitry without reducing the driving speed. Therefore, the addressing method of the present invention is beneficial for driving a three-electrode type surface discharge display panel.

We claim:

1. A method for addressing display cells of an A.C. three-electrode surface gas discharge panel having plural display electrode pairs parallel to each other and plural select electrodes insulated from and arranged to intersect perpendicularly the display electrode pairs, the intersections of the select electrodes and one display electrode in each display electrode pair defining a plurality of select cells and each display electrode pair defining plural display cells between the display electrodes at positions adjacent to corresponding ones of the select cells, and addressing method comprising the steps of (a) applying a firing voltage across display electrode pair to generate a discharge in the display cells defined by said display electrode pair;

(b) applying a select voltage to selected select electrodes to generate a discharge in the select cells corresponding to non-selected display cells in which the discharge is to be erased, so that the wall charge in each of the non-selected display cells in eliminated; and (c) applying a sustaining voltage across the display electrode pair to sustain discharges in the selected display cells.

2. A method for driving a gas discharge panel according to claim 1, wherein said step (c) further comprises applying an asymmetrical composite sustaining voltage so that the amplitude of the sustaining voltage applied to the one display electrode which defines the select cell is larger than the amplitude of the sustaining voltage applied to the other display electrode.

3. A method for driving a gas discharge panel according to claims 1 or 2, further comprising the step of sequentially performing said step (a) for each display electrode pair in the panel, and sequentially performing said step (b) for each display electrode pair in the panel.

4. A method for driving a gas discharge panel having a plurality of display electrode pairs, a plurality of select electrodes insulated from and arranged to intersect the display electrode pairs, one display electrode of each display electrode pair being connected in common with the corresponding one electrode of other display electrodes pairs to form at least one group, and the other display electrode of each display electrode pair being connected in common with the corresponding other display electrode of other display electrode pairs to form at least one group, said method comprising the steps of:

(a) generating discharges in display cells defined by a selected display electrode pair by applying a firing voltage across the selected display electrode pair;

(b) erasing the discharge in non-selected display cells defined by the selected display electrode pair by applying a select voltage across the select electrodes defining select cells corresponding to the non-selected display cells and the other display electrode of the selected display electrode pair to generate a discharge in the select cells corresponding to the non-selected display cells; and (c) sustaining the discharging of the selected display cells by applying an AC sustaining voltage to the selected display electrode pair.

5. A method for driving a dischage panel having a plurality of parallel display electrode pairs and a purality of selection electrodes insulated from and arranged to intersect the display electrode pairs, the intersecitons of the select electrodes and one display electrode in each display electrode pair defining a plurality of select cells and each display electrode pair defining a plurality of display cells adjacent to corresponding ones of the select cells, one display electrode of each display electrode pair being connected in common with the corresponding one electrode of at least one other display electrode pair to form a group, and the other display electrode of each electrode in each group being operated individually, comprising the steps of:

(a) generating discharges in all of the display cells defined by the display electrode pairs forming a group;

(b) generating discharges in all of the select cells defined by the intersections of a selected select electrode and the display electrode pairs forming the group;

(c) selectively applying a sustaining voltage to each display electrode pair in the group which defines a selected display cell adjacent to the select cell discharge in said step (b); and (d) repeating said steps (b) and (c) for each select electrode.

6. A method according to claim 3, wherein said sequentially performing step comprises performing said step (a) prior to said step (b) for each display elecrode pair.

7. A method according to claim 6, wherein said sequentially performing step comprises beginning the suquential performance of said step (b) at the approximate time of the third performance of said step (a).

8. A method according to claim 4, further comprising the step of sequentially performing said steps (a) and (b) for each display electrode pair in the panel.

9. A method of driving a gas discharge panel having plural display electrode pairs and plural select electrodes insulated from and arranged to intersect the display electrode pairs, each display electrode pair including first and second display electrodes, the intersections of the select electrode and the second display electrode of each display electrode pair defining a plurality of select cells and each display electrode pair defining plural display cells at positions adjacent to respective ones of the select cells, said method comprising the steps of:

(a) applying sustaining voltage across a selected display electrode pair;

(b) generating discharges in the display cells defined by said selected electrode pair; and (c) erasing the discharge in a non-selected one of the display cells defined by the selected display electrode pair by generating a discharge in the select cell corresponding to the non-selected display cell, so that discharges are generated in selected display cells by the sustaining voltage.

10. A method according to claim 9, further comprising the step of sequentially performing sid steps (a), (b) and (c) for each display electrode pair in the panel.

11. A method according to claim 10, wherein said step (b) comprises generating discharges by superimposing a firing voltage on the sustaining voltage.

12. A method according to claim 11, wherein said step (a) comprises applying an asymmetrical sustaining voltage, so that the amplitude of the sustaining voltage applied to the first display electrode is larger than the amplitude of the sustaining voltage applied to the second display electrode.

13. A method according to claim 12, wherein said step (c) comprises generating a discharge in the select cell corresponding to the non-selected display cell by applying an asymmetrical select voltage across the select electrode defining the select cell and the second display electrode, so that the amplitude of the select voltage applied to the second display electrode is greater than the amplitude of the select voltage applied to the select electrode.

14. A method according to claim 13, wherein:

said step (a) comprises applying a sustaining voltage waveform having plural sustaining voltage pulses; and said step (c) comprises extracting the sustaining voltage pulse immediately following the application of the select voltage from the sustaining voltage waveform applied to the first sustaining electrode.

* * * * *